US006974185B2

(12) United States Patent
Hsieh

(10) Patent No.: US 6,974,185 B2
(45) Date of Patent: Dec. 13, 2005

(54) HEIGHT ADJUSTABLE CHAIR FOR A KEYBOARD INSTRUMENT

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 10/824,209

(22) Filed: Apr. 13, 2004

(65) Prior Publication Data

US 2005/0225127 A1 Oct. 13, 2005

(51) Int. Cl.[7] ..... A47C 4/00

(52) U.S. Cl. ..... 297/16.1; 108/118; 108/117; 38/137; 297/56

(58) Field of Search ..... 297/16.1, 423.41, 297/423.45, 344.45, 19, 53, 461, 56, 334, 297/42, 45; 108/117, 118, 132, 124, 120; 248/166, 394, 396; 38/137, 106, DIG. 3, 38/103

(56) References Cited

U.S. PATENT DOCUMENTS 316,363 A * 4/1885 Hough ..... 108/116
431,530 A * 7/1890 Rock ..... 108/117
1,359,527 A * 11/1920 Reed ..... 108/6
2,662,319 A * 12/1953 Hortman, Jr. ..... 108/117
2,671,975 A * 3/1954 Wear ..... 108/117
2,693,652 A * 11/1954 Kutz ..... 108/117
2,908,984 A * 10/1959 Lantz ..... 108/117
3,206,881 A * 9/1965 Kleinsorge ..... 38/137
4,362,196 A * 12/1982 Ferdinand et al. ..... 144/286.1
4,686,910 A * 8/1987 Skjerseth ..... 108/118
4,714,224 A * 12/1987 Calmes ..... 248/465
5,272,825 A * 12/1993 Simpson ..... 38/137
5,335,604 A * 8/1994 Jiang ..... 100/119
5,379,655 A * 1/1995 Yeakle ..... 73/865.7
5,400,720 A * 3/1995 Stevens ..... 108/147
5,478,138 A * 12/1995 Yu ..... 297/461
5,584,254 A * 12/1996 Williams ..... 108/118
5,739,443 A * 4/1998 Saunders ..... 73/866.5
5,927,436 A * 7/1999 Schutz ..... 182/153
6,006,580 A * 12/1999 Frawley ..... 72/458
6,467,739 B1 * 10/2002 Jou ..... 248/166
6,516,478 B2 * 2/2003 Cook et al. ..... 5/611

* cited by examiner

*Primary Examiner*—Peter M. Cuomo
*Assistant Examiner*—Erika Garrett
(74) *Attorney, Agent, or Firm*—Dellett & Walters

(57) ABSTRACT

A chair includes a seat, two legs, two transverse bars, a first cross bar securely and firmly formed on one of the two legs and sandwiched between the two transverse bars and a second cross bar securely and firmly formed on the other one of the two legs and sandwiched between the two transverse bars. The second cross bar has two securing blocks extending out of two distal ends of the second cross bar and into corresponding two securing holes defined in the inner side faces of the two transverse bars so as to secure position of the second cross bar relative to the seat, the two securing blocks being selectively retracted inside the second cross bar and having escaped the corresponding securing holes. The chair height is able to be adjusted by moving the second cross bar to different securing holes.

18 Claims, 8 Drawing Sheets

HEIGHT ADJUSTABLE CHAIR FOR A KEYBOARD INSTRUMENT

BACKGROUND OF THE INVENTION

1. Field of the Invention

The present invention relates to a chair with height adjusting ability, and more particularly to a height adjustable chair for a keyboard instrument.

2. Description of Related Art

With reference to FIG. 9, a first conventional height adjustable chair is shown to have a seat (50), two transverse bars (51) horizontally attached to a bottom face of the seat (50) and two legs (52) each with a cross bar (522) formed on a first distal end of the leg (52) and a foot (524) formed on a second distal end of the leg (52) to engage with a surface, i.e. the ground. An inner side face of each of the transverse bars (51) is provided with multiple adjusting holes (511). The two legs (52) intersect with one another and a pin (521) is provided to extend through a joint between the two legs (52) such that the two legs (52) are pivotally connected to one another. Each cross bar (522) is a hollow tubular-like element to receive therein a spring (54) and provided with two slits (53) each defined in opposite distal edge of the cross bar (522) to respectively receive therein a handle (531). Therefore, it is noted that the spring (54) is sandwiched between the two handles (531). Each handle (531) is provided with a head (532) extending out and into one of the adjusting holes (511) such that the chair is fixed after the two heads (532) of the two handles (531) have been extended into two mutually aligned adjusting holes (511).

Normally, due to the resilient force to the handles (531) via the spring (54), the two heads (532) are received in corresponding adjusting holes (511). When adjustment of the chair height is required, the operator is able to use both hands to pull the two handles (531) to drive the heads (532) away from the adjusting holes (511) and simultaneously compress the spring (54). Thereafter, the operator is able to adjust the height of the chair by moving the legs (52) between the two transverse bars (51).

However, adjusting the position of the cross bar (522) relative to the transverse bar (51) requires the operator to simultaneously pull the two handles (531) on the same cross bar (522), which is quite troublesome and difficult.

With reference to FIG. 10, a different conventional height adjustable chair is shown and has a seat (60) and two legs (61) interconnecting with each other. Each leg (61) has multiple adjusting holes (611) defined along a length of the leg (61). Thus a pin (62) extending through two aligned adjusting holes (611) respectively on each of the two legs (61) is able to secure the engagement between the two legs (61). Changing the position of the pin (62) is then able to change the height of the chair. However, it is noted that after the pin (62) is withdrawn from two aligned adjusting holes (611), the operator has to realign two different adjusting holes (611) to allow the extension of the pin (62). Realigning two different adjusting holes (611) requires extreme focus otherwise the pin (62) may not be able to extend therethrough. Furthermore, the operator has to spare one hand to hold the chair in position or the two adjusting holes (611) from different legs (61) may not be aligned even after the alignment is readjusted. Therefore, the conventional chair is not handy in use.

To overcome the shortcomings, the present invention tends to provide an improved height adjustable chair to mitigate the aforementioned problems.

SUMMARY OF THE INVENTION

The primary objective of the present invention is to provide an improved height adjustable chair whereby the operator is only required to pull a handle to release the positioning mechanism of the chair and then the chair is ready for height change.

Another objective of the present invention is that the handle is connected to a driving plate by a linking element and the driving plate is respectively and pivotally connected to a first driving plate and a second driving plate. Thus the pivotal movement of the handle is able to drive the first and second driving plates to move simultaneously to retract two positioning blocks and the chair is ready for height change.

Other objects, advantages and novel features of the invention will become more apparent from the following detailed description when taken in conjunction with the accompanying drawings.

DETAILED DESCRIPTION OF THE PREFERRED EMBODIMENT

Figure 1:
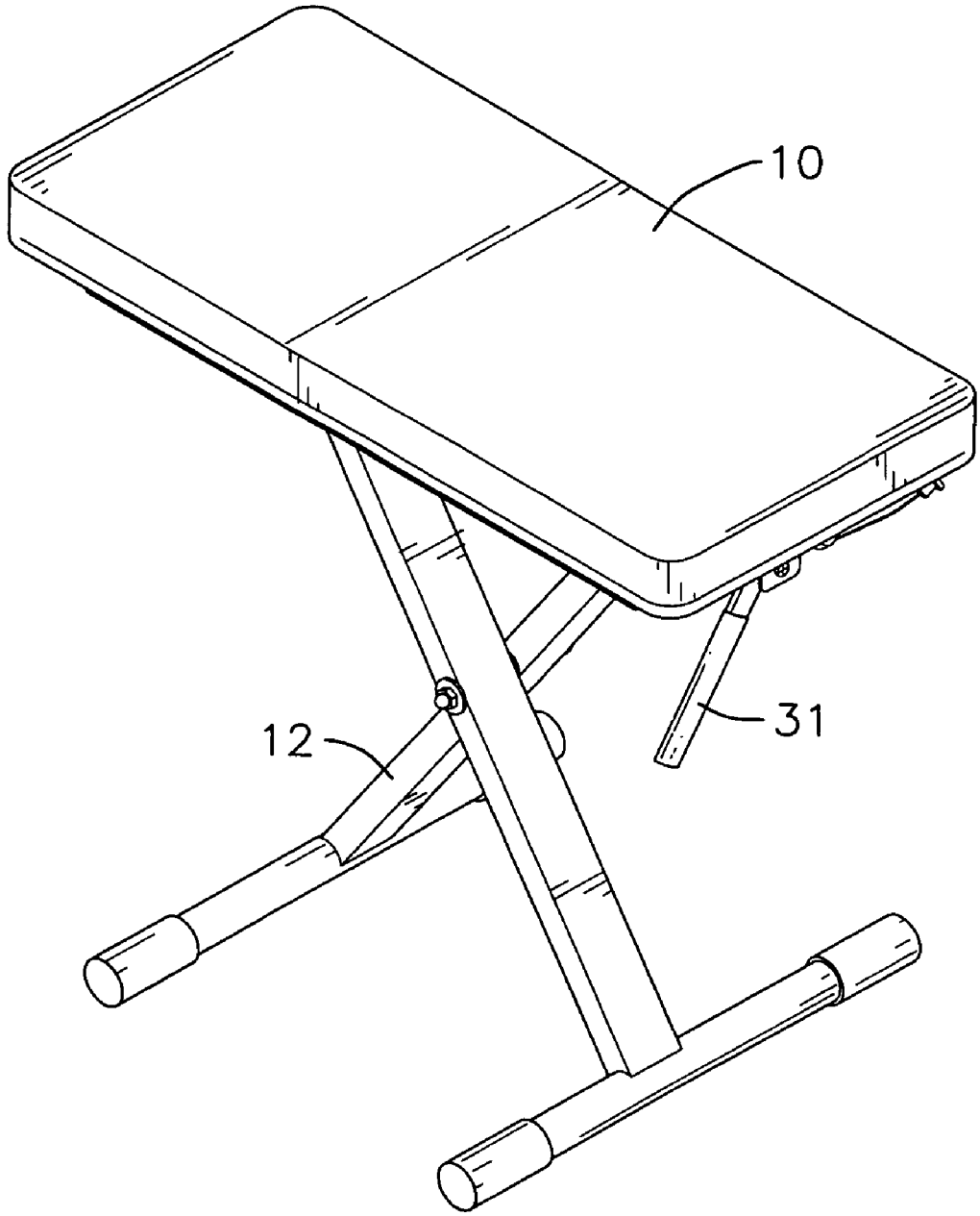
FIG. 1 is a perspective view of the height adjustable chair of the present invention.
Figure 2:
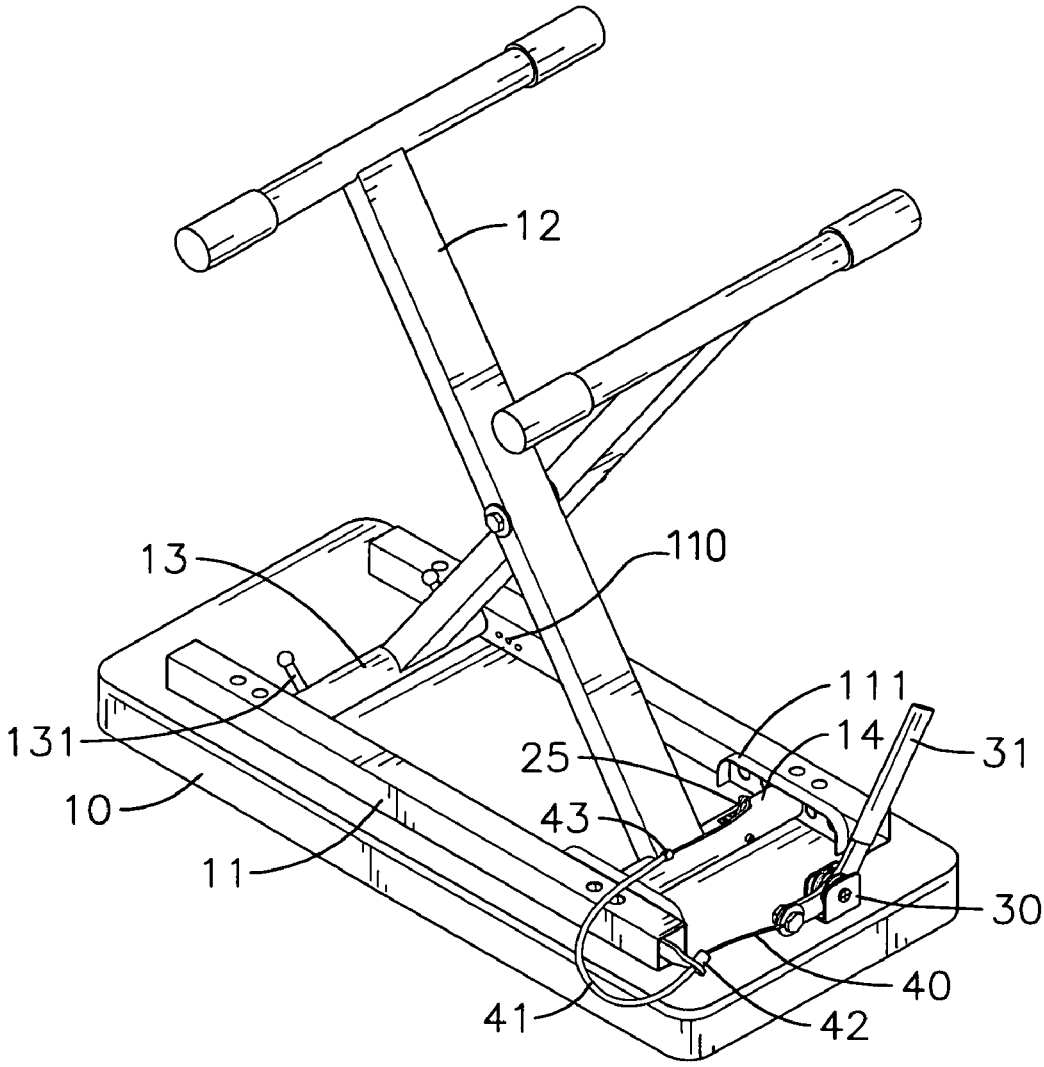
FIG. 2 is a perspective view showing that the chair of the present invention is placed upside down to see the adjustable mechanism of the present invention.

With reference to FIGS. 1 and 2, it is noted that the height adjustable chair in accordance with the present invention includes a seat (10) and two legs (12) pivotally interconnected with one another.

Figure 9:
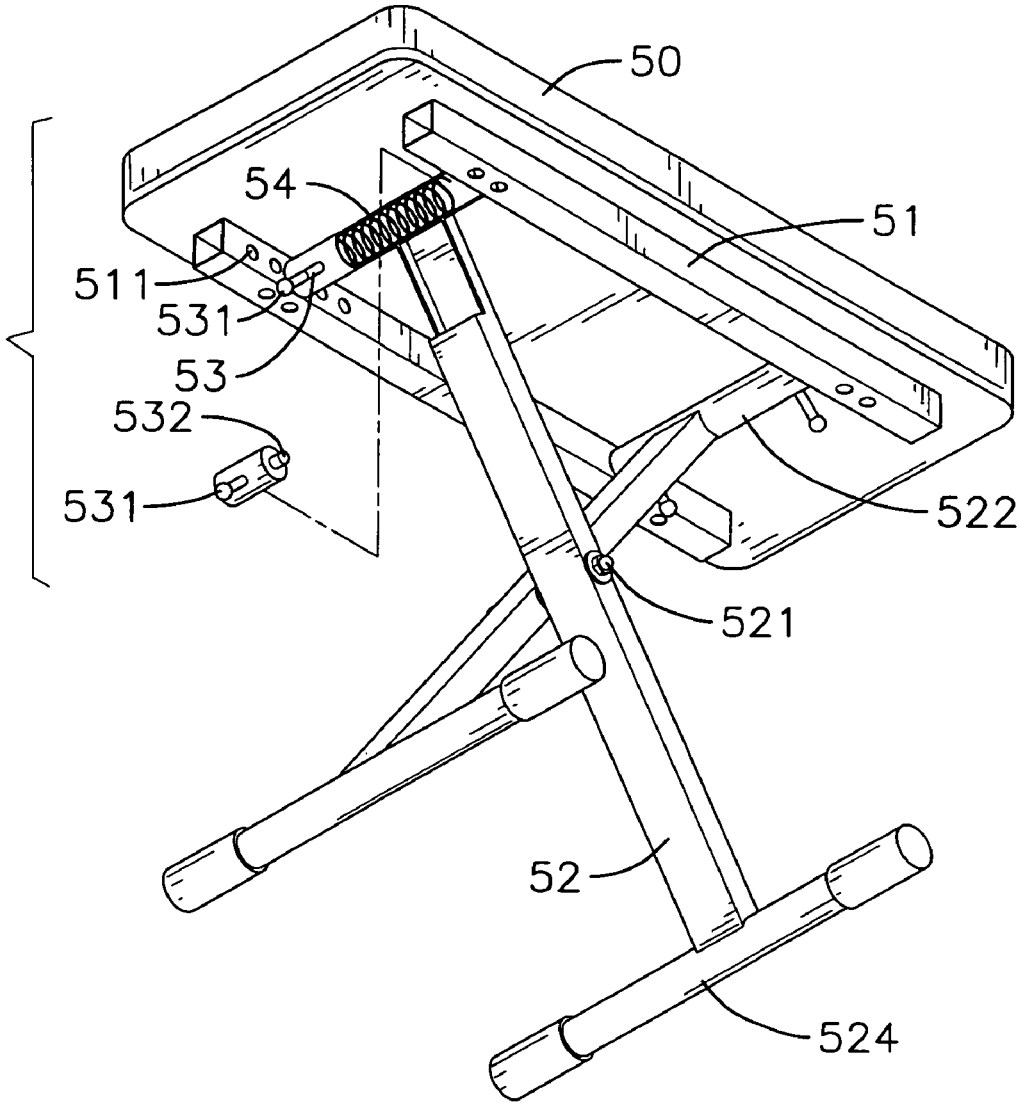
FIG.9 PRIOR ART
FIG. 9 is a perspective view of a conventional height adjustable chair.
Figure 10:
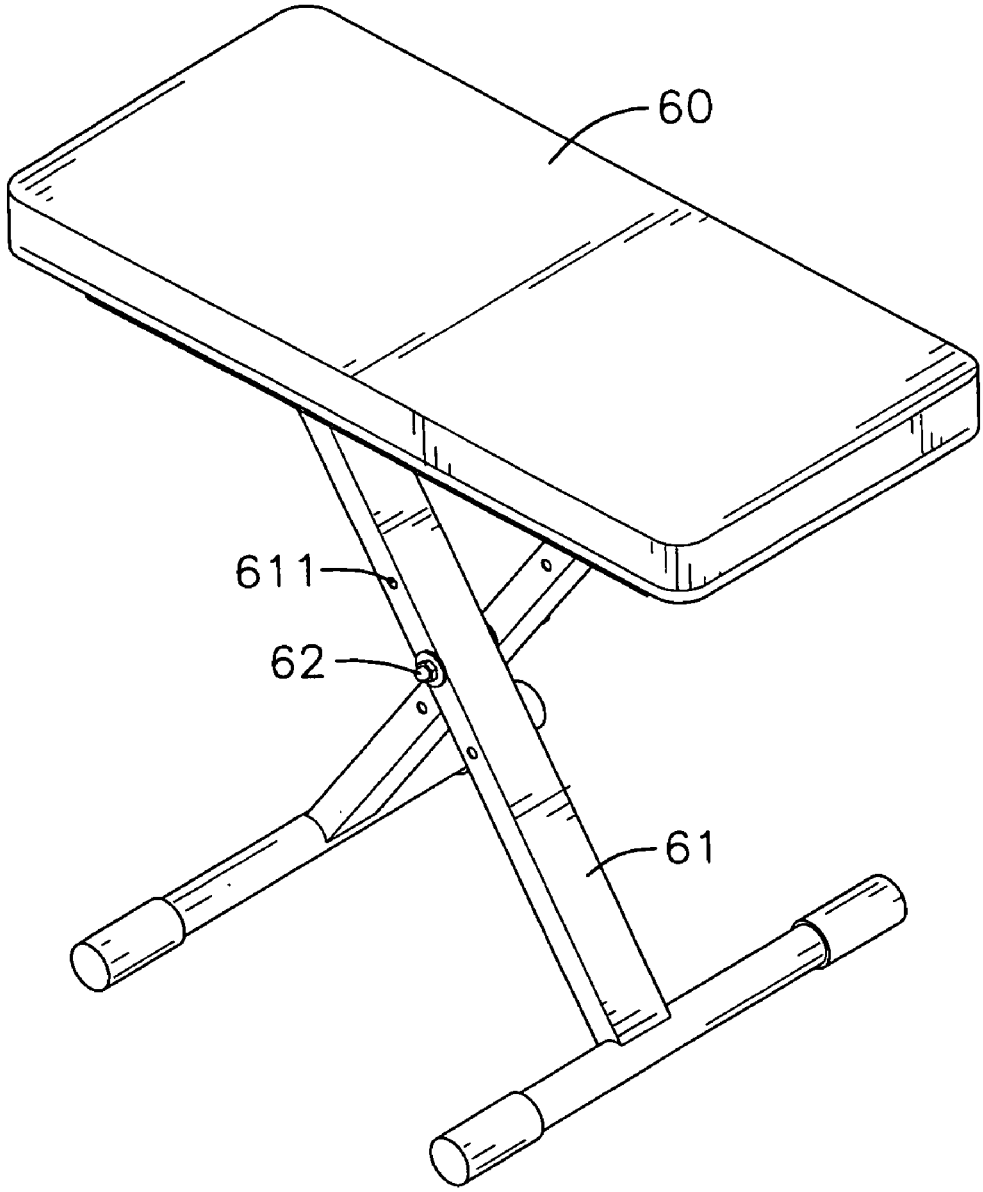
FIG.10 PRIOR ART
FIG. 10 is a perspective view of a conventional height adjustable chair.

Two transverse bars (11) are horizontally and securely attached to a bottom face of the seat (10). A first cross bar (13) and a second cross bar (14) are sandwiched between the two transverse bars (11). An inner side face of each of the two transverse bars (11) is provided with multiple adjusting holes (110) to respectively receive therein a spring-driven positioning lever (131). That is, two spring-driven positioning levers (131) are respectively received inside two mutually aligned adjusting holes (110) respectively defined in the inner side faces of the two transverse bars (11) to position one of the legs (12). Because the structure and function of how the positioning lever (131) works is the same as that described in the description to FIG. 9, detailed description thereof is thus omitted.

Figure 3:
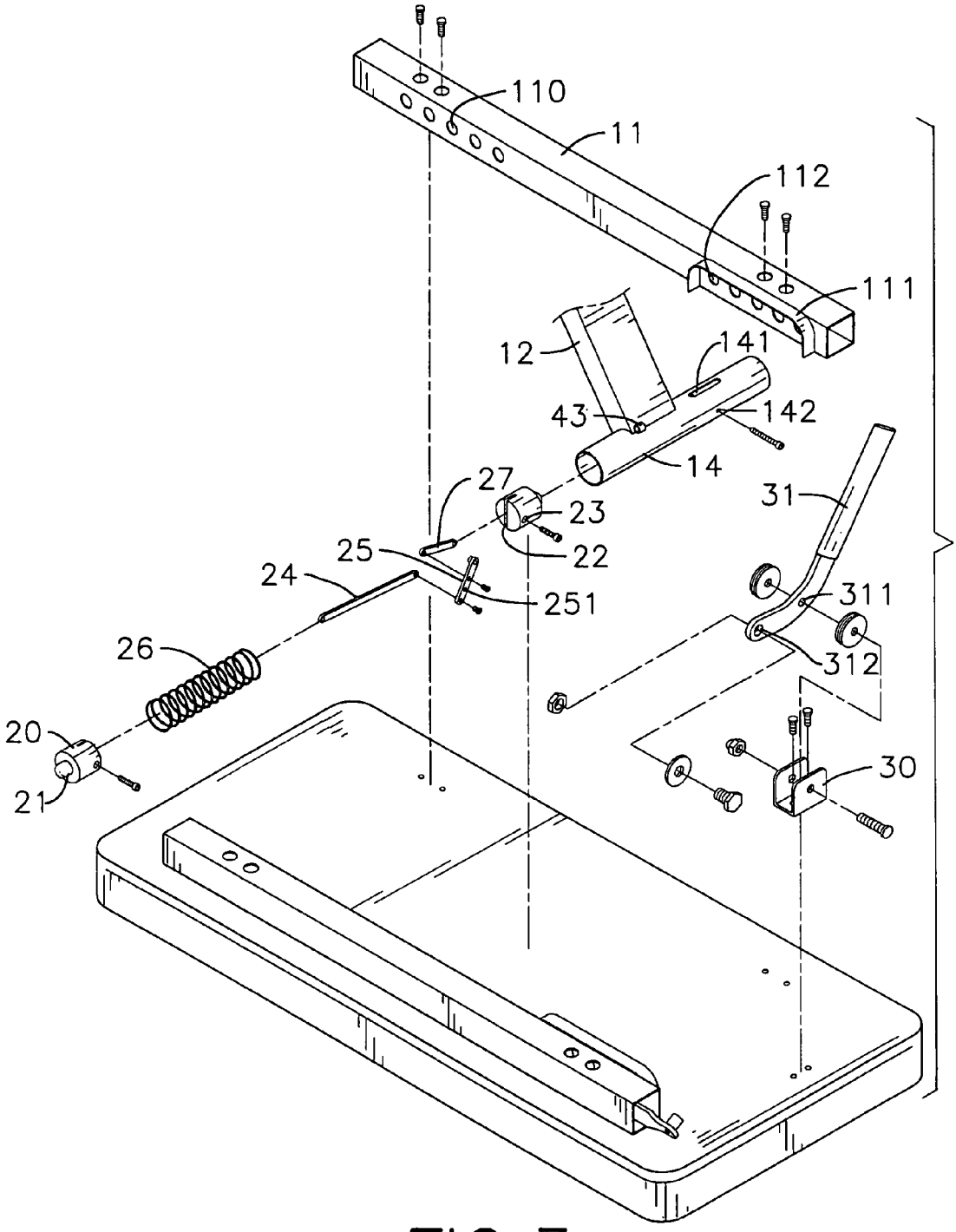
FIG. 3 is an exploded perspective view showing the elements of the adjustable mechanism.

With reference to FIGS. 2 and 3 for a better understanding of the structure of the present invention, it is noted that opposite to the adjusting holes (110), multiple securing holes (112) are defined in the inner side faces of the two transverse bars (11). An arcuate stop (111) is formed on the inner side face to enclose the securing holes (112).

The appropriate leg (12) is securely and fixedly connected to the second cross bar (14) which is hollow and has two open ends and a window (141) defined through a periphery of the second cross bar (14). Two securing blocks (20) are movably received in the hollow second cross bar (14) and respectively have a head (21) formed on a front face thereof and extending out of the two open ends of the hollow second cross bar (14), a slit (22) defined in a rear face thereof and a second pin hole (23) defined in a side face thereof to communicate with the slit (22).

A driving plate (25) is received in the hollow second cross bar (14) with one distal end of the driving plate (25) extending out of the window (141) and has a third pin hole (251) aligned with the first pin hole (142) of the second cross bar (14) to allow a pin (shown but not labeled) to extend through the aligned first pin hole (142) and the third pin hole (251) of the driving plate (25) such that the driving plate (25) is pivotally received inside the second cross bar (14).

A first driving plate (24) has a first distal end pivotally connected to a bottom portion of the driving plate (25) and a second distal end extending through a spring (26) and into the slit (22) of one of the two securing blocks (20) so that a pin (shown but not numbered) is able to extend through the second pin hole (23) and into the second distal end of the first driving plate (24) to secure engagement between the first driving plate (24) and one of the two securing blocks (20).

A second driving plate (27) has a first distal end extending into the slit (22) of the other securing block (20) to allow a pin (shown but not numbered) to extend through the second pin hole (23) and into the first distal end of the second driving plate (27) to secure engagement between the second driving plate (27) and the other securing block (20). At the moment, pivotal movement of the driving plate (25) is able to drive the first and second driving plates (24,27) to move toward and away from the driving plate (25) and the two securing blocks (20) are able to selectively extend out of the two open ends of the second cross bar (14). Furthermore, due to the spring (26) being sandwiched between one of the two securing blocks (20) and the driving plate (25), the pivotal movement of the driving plate (25) is able to reciprocally compress the spring (26), which is able to selectively provide a recoil force to the securing blocks (20) to force the securing blocks (20) to return to their original positions.

A substantially U-shaped mounting seat (30) is firmly mounted on the bottom face of the seat (10) and has a handle (31) pivotally received between the U-shaped mounting seat (30) in any appropriate method known in the art.

Figure 4:
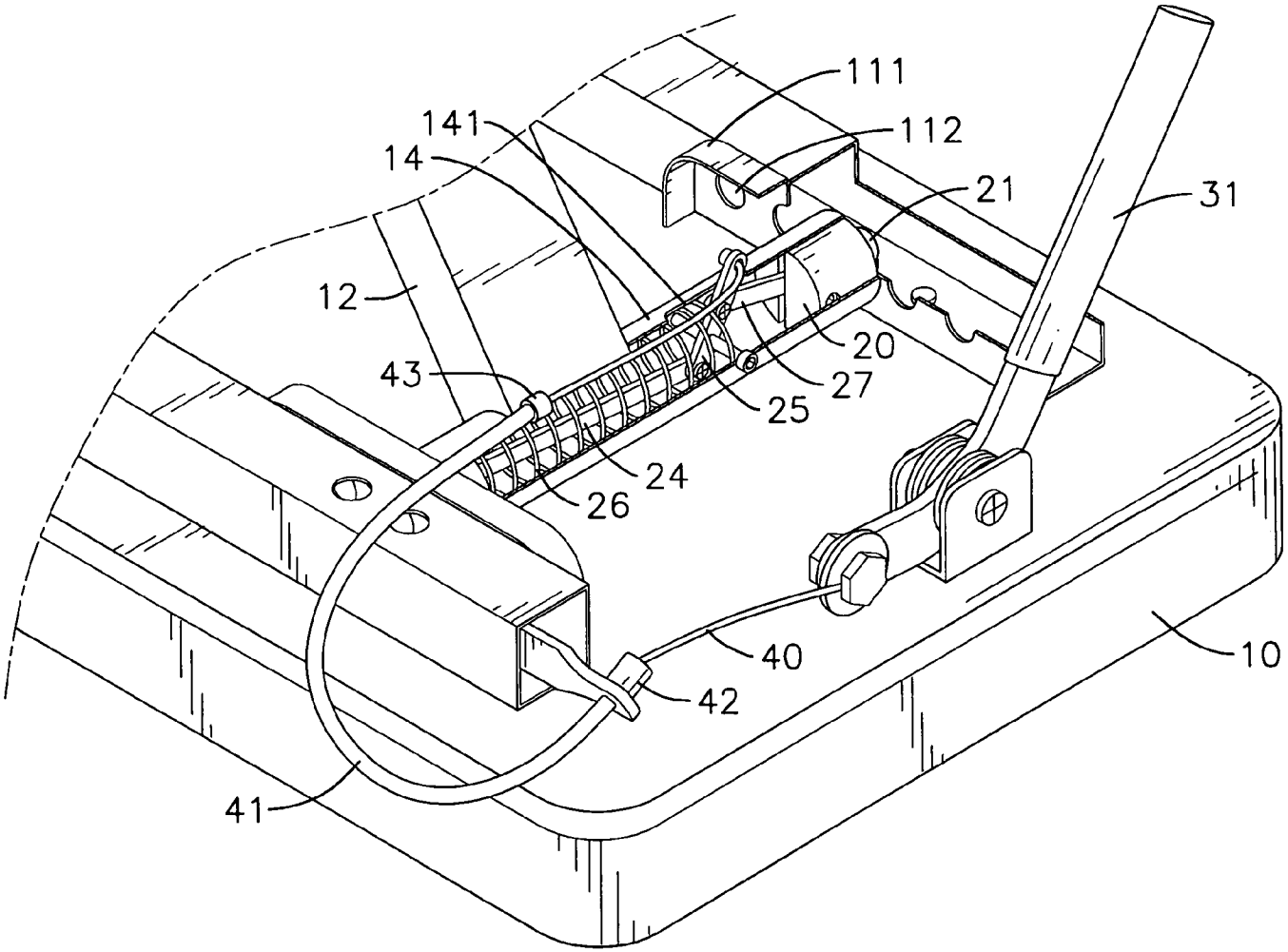
FIG. 4 is an enlarged perspective view showing the assembly of the adjustable mechanism.

With reference to FIG. 4, it is noted that a linking element (40), preferably a cable, has a first distal end securely connected to a distal end of the linking element (40) and a second distal end securely connected to the distal end of the driving plate (25) extending out of the window (141). A major portion of the linking element (40) is enclosed in an encapsulation (41) and two caps (42,43) are provided to two distal ends of the encapsulation (41) for protection of the operator.

Figure 5:
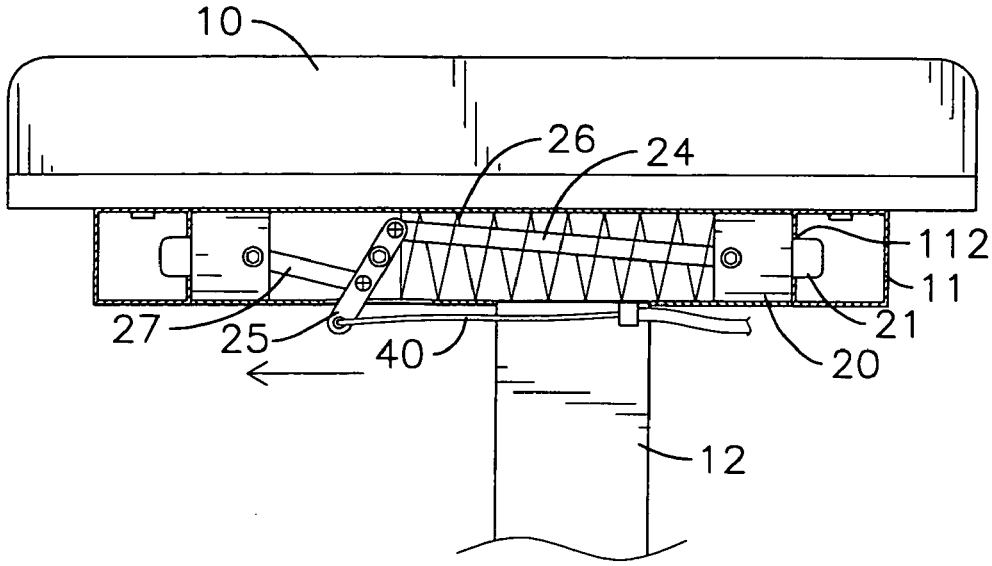
FIGS. 5 and 6 are schematic side plan views showing the adjustment of the adjustable mechanism of the present invention.
Figure 6:
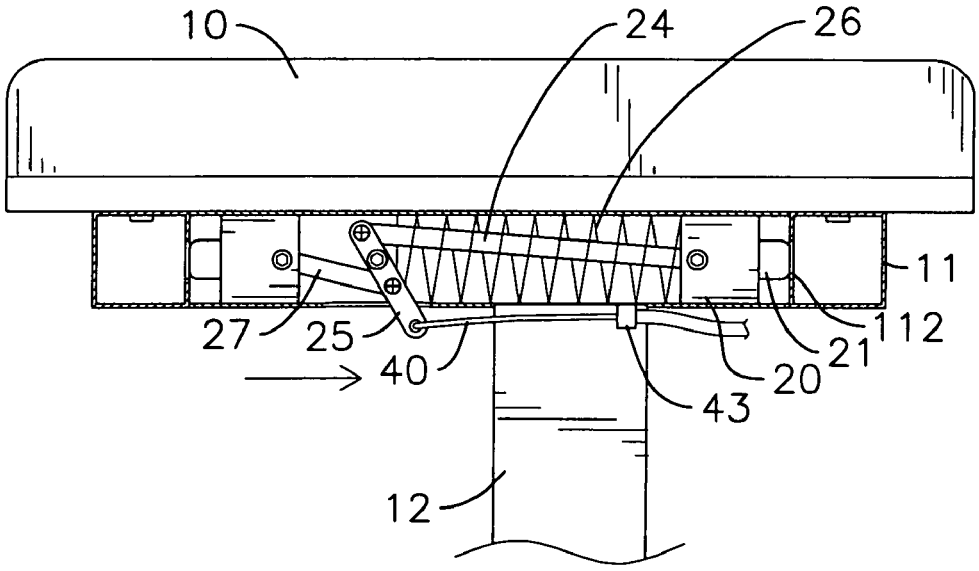

With reference to FIGS. 5 and 6, it is noted that when the handle (31) is pivoted in a direction as indicated in the arrow shown in FIG. 5, the linking mechanism of the driving plate (25) to the first and second driving plates (24,27) causes the first and second driving plates (24,27) to move toward the driving plate (25), which also causes the two securing blocks (20) to move toward each other. After the two securing blocks (20) are moved, the heads (21) of the two securing blocks (20) leave the corresponding securing holes (112) on opposite inner side faces of the two transverse bars (11) to allow the second cross bar (14) to move between the two transverse bars (11). However, because of the stops (111) on each of the two transverse bars (11), movements of the securing blocks (20) are limited within the stops (111) to prevent collapses caused by excessive movement of the securing blocks (20). After the two securing blocks (20) are re-aligned with two securing holes (112) on opposite transverse bars (11), the operator releases the handle (31) to allow the recoil force of the spring (26) to return the two securing blocks (20) to extend out of the two open ends of the second cross bar (14) and into the two aligned securing holes (112) to once again fix the position of the second cross bar (14) in respect to the seat (10).

Figure 7:
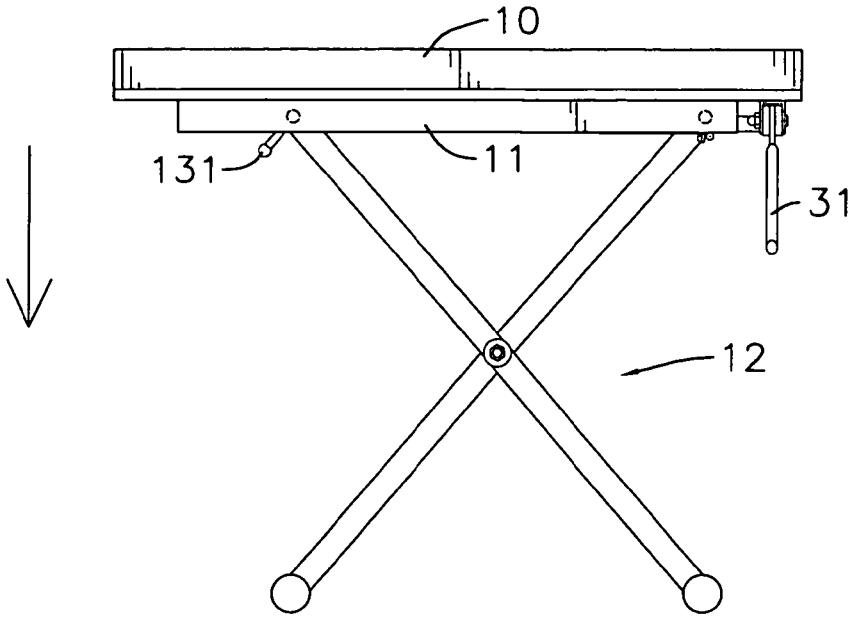
FIGS. 7 and 8 are schematic side plan views showing the height of the chair is changed in response to the adjustment of the adjustable mechanism.
Figure 8:
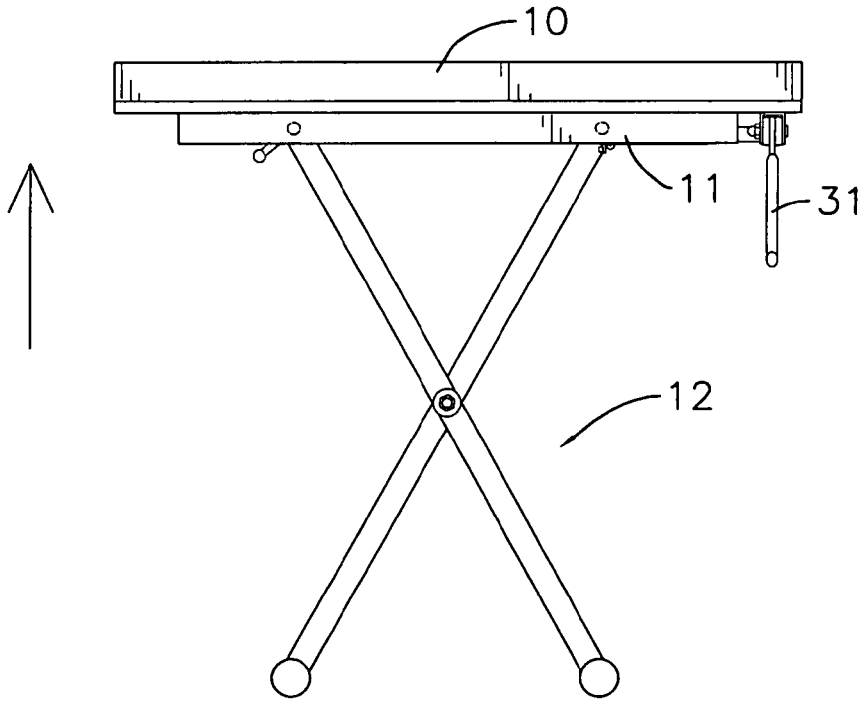

With reference to FIGS. 7 and 8, it is noted that during adjustment of the chair, the height of the chair is able to be freely adjusted to meet different users of different heights.

With the foregoing description of the adjusting mechanism of the present invention, it is noted that to activate the adjusting mechanism of the present invention, the operator only needs to pivot the handle (31) to retract the two securing blocks, move the second cross bar (14) to an appropriate position and then release the handle (31) to relocate the two securing blocks (20) to position the second cross bar (14) relative to the seat (10). Therefore, the height adjustment of the chair of the present invention is easy and simple without any flipping of the chair.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A chair comprising:

a seat;

two legs pivotally interconnected to each other;

two transverse bars horizontally and securely attached to a bottom face of the seat;

a first cross bar securely and firmly formed on one of the two legs and sandwiched between the two transverse bars, the first cross bar having two spring-driven positioning levers respectively and selectively extending out of two distal ends of the first cross bar and into two mutually corresponding and aligned adjusting holes defined in inner side faces of the two transverse bars to fix a position of the first cross bar relative to the seat;

a second cross bar securely and firmly formed on the other one of the two legs and sandwiched between the two transverse bars, the second cross bar having two securing blocks extending out of two distal ends of the second cross bar and into corresponding two securing holes defined in the inner side faces of the two transverse bars so as to secure a position of the second cross bar relative to the seat, the two securing blocks being selectively retracted inside the second cross bar and having escaped the corresponding securing holes, and a handle is pivotally mounted at the bottom face of the seat to operably connect to the two securing blocks so that the pivotal movement of the handle is able to drive the two securing blocks to move, whereby the chair height is able to be adjusted by moving the second cross bar to different securing holes.

2. The chair as claimed in claim 1 further comprising a driving plate pivotally received in the second cross bar and having a distal end extending out of the second cross bar, a first driving plate with a first end securely connected to one of the two securing blocks and a second end pivotally connected to the driving plate and a second driving plate with a first end securely connected to the other one of the two securing blocks and a second end pivotally connected to the driving plate, so that the pivotal movement of the driving plate is able to control the two securing blocks to move inside the second cross bar.

3. The chair as claimed in claim 1, wherein the handle is operably connected to the distal end of the driving plate extending out of the second cross bar by a linking element such that the pivotal movement of the handle is able to drive the driving plate to pivot inside the second cross bar.

4. The chair as claimed in claim 1 further comprising a spring compressibly received between the two securing blocks to provide a recoil force to the two securing blocks.

5. The chair as claimed in claim 2 further comprising a spring compressibly received between one of two securing blocks and the driving plate to provide a recoil force to one of the two securing blocks.

6. The chair as claimed in claim 3 further comprising a spring compressibly received between one of two securing blocks and the driving plate to provide a recoil force to one of the two securing blocks.

7. The chair as claimed in claim 1 further comprising an arcuate stop enclosing the securing holes to limit movement of the securing blocks after the two securing blocks are retracted inside the second cross bar.

8. The chair as claimed in claim 2 further comprising an arcuate stop enclosing the securing holes to limit movement of the securing blocks after the two securing blocks are retracted inside the second cross bar.

9. The chair as claimed in claim 3 further comprising an arcuate stop enclosing the securing holes to limit movement of the securing blocks after the two securing blocks are retracted inside the second cross bar.

10. The chair as claimed in claim 4 further comprising an arcuate stop enclosing the securing holes to limit movement of the securing blocks after the two securing blocks are retracted inside the second cross bar.

11. The chair as claimed in claim 6 further comprising an arcuate stop enclosing the securing holes to limit movement of the securing blocks after the two securing blocks are retracted inside the second cross bar.

12. A chair comprising:

a seat;

two legs pivotally interconnected to each other;

two transverse bars horizontally and securely attached to a bottom face of the seat;

a first cross bar securely and firmly formed on one of the two legs and sandwiched between the two transverse bars, the first cross bar having two spring-driven positioning levers respectively and selectively extending out of two distal ends of the first cross bar and into two mutually corresponding and aligned adjusting holes defined in inner side faces of the two transverse bars to fix a position of the first cross bar relative to the seat;

a second cross bar securely and firmly formed on the other one of the two legs and sandwiched between the two transverse bars, the second cross bar having two securing blocks extending out of two distal ends of the second cross bar and into corresponding two securing holes defined in the inner side faces of the two transverse bars so as to secure a position of the second cross bar relative to the seat, the two securing blocks being selectively retracted inside the second cross bar and having escaped the corresponding securing holes, and a spring compressibly received between one of two securing blocks and a driving plate to provide a recoil force to one of the two securing blocks, whereby the chair height is able to be adjusted by moving the second cross bar to different securing holes.

13. The chair as claimed in claim 12 further comprising the driving plate being pivotally received in the second cross bar and having a distal end extending out of the second cross bar, a first driving plate with a first end securely connected to one of the two securing blocks and a second end pivotally connected to the driving plate and a second driving plate with a first end securely connected to the other one of the two securing blocks and a second end pivotally connected to the driving plate so that the pivotal movement of the driving plate is able to control the two securing blocks to move inside the second cross bar.

14. The chair as claimed in claim 12, wherein the handle is operably connected to the distal end of the driving plate extending out of the second cross bar by a linking element such that the pivotal movement of the handle is able to drive the driving plate to pivot inside the second cross bar.

15. The chair as claimed in claim 12 further comprising an arcuate stop enclosing the securing holes to limit movement of the securing blocks after the two securing blocks are retracted inside the second cross bar.

16. The chair as claimed in claim 12 further comprising an arcuate stop enclosing the securing holes to limit movement of the securing blocks after the two securing blocks are retracted inside the second cross bar.

17. The chair as claimed in claim 13 further comprising an arcuate stop enclosing the securing holes to limit movement of the securing blocks after the two securing blocks are retracted inside the second cross bar.

18. The chair as claimed in claim 14 further comprising an arcuate stop enclosing the securing holes to limit movement of the securing blocks after the two securing blocks are retracted inside the second cross bar.

* * * * *